US007435923B2

(12) United States Patent
Bleckmann et al.

(10) Patent No.: US 7,435,923 B2
(45) Date of Patent: Oct. 14, 2008

(54) ELECTRICAL SWITCHING DEVICE

(75) Inventors: Michael Bleckmann, Schwerte-Ergste (DE); Josef Frühauf, Horovice (CZ)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 0 days.

(21) Appl. No.: 12/012,596

(22) Filed: Feb. 4, 2008

(65) Prior Publication Data

US 2008/0156629 A1 Jul. 3, 2008

Related U.S. Application Data

(63) Continuation of application No. PCT/EP2006/009426, filed on Sep. 28, 2006.

(30) Foreign Application Priority Data

Sep. 30, 2005 (DE) ..... 10 2005 046 801

(51) Int. Cl.
*H01H 15/00* (2006.01)

(52) U.S. Cl. ..... 200/561; 200/5 A; 200/341

(58) Field of Classification Search ..... 200/5 A, 200/5 R, 1 B, 339, 341, 345, 17 R, 553, 561
See application file for complete search history.

(56) References Cited

U.S. PATENT DOCUMENTS 5,130,506 A * 7/1992 Zuercher et al. ..... 200/553
5,293,143 A 3/1994 Sakakino et al.
5,414,231 A 5/1995 Sato et al.
5,446,253 A * 8/1995 Oshgan ..... 200/556
6,054,655 A * 4/2000 Rudolph et al. ..... 200/16 R
6,332,929 B1 12/2001 Hartmann et al.
6,919,523 B1 * 7/2005 Lai ..... 200/402
7,009,128 B1 * 3/2006 Czarnecki et al. ..... 200/339

FOREIGN PATENT DOCUMENTS

DE 34 02 082 A1 7/1985
DE 197 21 213 A1 12/1998
GB 2 276 271 9/1994

* cited by examiner

*Primary Examiner*—Kyung Lee
(74) *Attorney, Agent, or Firm*—Brooks Kushman P.C.

(57) ABSTRACT

A switch having an actuating handle, a restoring mechanism, a contact carrier, and a rocker. The handle is rotatable to be movable upward and downward and moves downward in response to being actuated. The restoring mechanism is movable upward and downward and is biased to move upward. The handle forces the restoring mechanism to move downward in response to being actuated. The carrier is displaceable between two positions. The rocker is rotatable and an end of the rocker facing away from the swivel axis is engaged with the carrier. During downward movement the restoring mechanism swivels the rocker in a first direction thereby causing the rocker to displace the carrier from one position to the other. During upward movement the restoring mechanism swivels the rocker in an opposite direction thereby causing the rocker to displace the carrier back to the original position.

20 Claims, 2 Drawing Sheets

ELECTRICAL SWITCHING DEVICE

CROSS-REFERENCE TO RELATED APPLICATIONS

This is a continuation of International Application PCT/EP2006/009426, published in German, with an international filing date of Sep. 28, 2006, which claims priority to DE 10 2005 046 801.2, filed Sep. 30, 2005, the disclosures of which are both hereby incorporated by reference.

BACKGROUND OF THE INVENTION

1. Field of the Invention

The present invention relates to an electrical switching device having an actuating handle and a contact carrier in which actuation of the actuating handle causes the contact carrier to displace between end positions with each end position being associated with a respective contact on a printed circuit board.

2. Background Art

Such a switching device is used in a vehicle to switch over electrical potentials of devices such as drive motors for electrically driven window lifts, sliding roofs or seats, lighting devices, and the like. The switch over process is performed in a so-called keyed actuation in which the actuating handle and contact carrier return to their original position after actuation. The duration of the switch over process is a function of the actuation speed.

SUMMARY OF THE INVENTION

An object of the present invention includes an electrical switching device having an actuating handle and a contact carrier in which the electrical switch over process associated with displacement of the contact carrier occurs independently of the actuation speed of the actuating handle.

In carrying out the above object and other objects, the present invention provides a switching device having an actuating handle, a restoring mechanism, a contact carrier, and a rocker arm. The actuating handle is rotatable about a rotation axis to be movable upward and downward. The actuating handle moves downward in response to being actuated. The restoring mechanism is movable upward and downward. The restoring mechanism is biased with an elastic force to move upward. The actuating handle engages and forces the restoring mechanism to move downward in response to being actuated. The contact carrier is displaceable between first and second positions. The rocker arm is rotatable about a swivel axis parallel to the rotation axis of the actuating handle. An end of the rocker arm facing away from the swivel axis is engaged with the contact carrier. The restoring mechanism cooperates with the rocker arm such that during downward movement of the restoring mechanism the restoring mechanism abruptly swivels the rocker arm in a first swivel direction about the swivel axis thereby causing the rocker arm to abruptly displace the contact carrier from the first position to the second position and such that during upward movement of the restoring mechanism the restoring mechanism abruptly swivels the rocker arm in a second opposite swivel direction about the swivel axis thereby causing the rocker arm to abruptly displace the contact carrier back to the second position from the first position.

Further, in carrying out the above object and other objects, the present invention provides a switching device having a handle, first and second rods, first and second carriers, and first and second rockers. The handle is rotatable about a rotation axis. A first end of the handle moves downward from a neutral position in response to the handle being pulled. An opposite second end of the handle moves downward from the neutral position in response to the handle being pressed. The irst rod is adjacent to the first end of the handle and is movable upward and downward relative to the first end of the handle. The first rod is biased with an elastic force to move upward. The second rod is adjacent to the second end of the handle and is movable upward and downward relative to the second end of the handle. The second rod is biased with an elastic force to move upward. The first carrier is displaceable between first and second positions. The second carrier is displaceable between first and second positions. The first rocker is adjacent to the first rod and is rotatable about a first swivel axis parallel to the rotation axis of the handle. An end of the first rocker facing away from the first swivel axis is engaged with the first carrier. The second rocker is adjacent to the second rod and is rotatable about a second swivel axis parallel to the rotation axis of the handle. An end of the second rocker facing away from the second swivel axis is engaged with the second carrier.

The first end of the handle engages and forces the first rod to move downward while the first end of the handle moves downward in response to the handle being pulled. The first rod cooperates with the first rocker such that during downward movement of the first rod the first rod abruptly swivels the first rocker in a first swivel direction about the first swivel axis thereby causing the first rocker to abruptly displace the first carrier from the first position to the second position and such that during upward movement of the first rod the first rod abruptly swivels the first rocker in a second opposite swivel direction about the first swivel axis thereby causing the first rocker to abruptly displace the first carrier back to the second position from the first position. During upward movement of the first rod when the pulling of the handle ceases, the first rod engages and forces the first end of the handle to move upward back to the neutral position.

Similarly, the second end of the handle engages and forces the second rod to move downward while the second end of the handle moves downward in response to the handle being pressed. The second rod cooperates with the second rocker such that during downward movement of the second rod the second rod abruptly swivels the second rocker in a first swivel direction about the second swivel axis thereby causing the second rocker to abruptly displace the second carrier from the first position to the second position and such that during upward movement of the second rod the second rod abruptly swivels the second rocker in a second opposite swivel direction about the second swivel axis thereby causing the second rocker to abruptly displace the second carrier back to the second position from the first position. During upward movement of the second rod when the pressing of the handle ceases, the second rod engages and forces the second end of the handle to move upward back to the neutral position.

The second rod remains in place while the first rod is moving upward or downward. Similarly, the first rod remains in place while the second rod is moving upward or downward.

In an embodiment, the restoring mechanism for the actuating handle includes a spring-loaded push rod. The push rod is perpendicularly movable relative to the contact carrier. The push rod cooperates with a rocker arm. The rocker arm is supported so as to be rotatable about a swivel axis. The end of the rocker arm facing away from the swivel axis is engaged to the contact carrier. During downward movement of the push rod, which occurs in response to actuation of the actuating handle, the push rod causes the rocker arm to abruptly swivel. This abrupt swiveling of the rocker arm causes the abrupt displacement of the contact carrier from a first end position to a second end position as a result of the rocker arm being engaged to the contact carrier. During upward movement of the push rod, which occurs in response to the actuation of the actuating handle ceasing, the push rod pushes the actuating handle back to its starting position and causes the rocker arm to abruptly swivel in an opposite swivel direction. This opposite abrupt swiveling of the rocker arm causes the abrupt displacement of the contact carrier back to the first end position from the second end position.

DETAILED DESCRIPTION OF THE PREFERRED EMBODIMENT(S)

Figure 1:
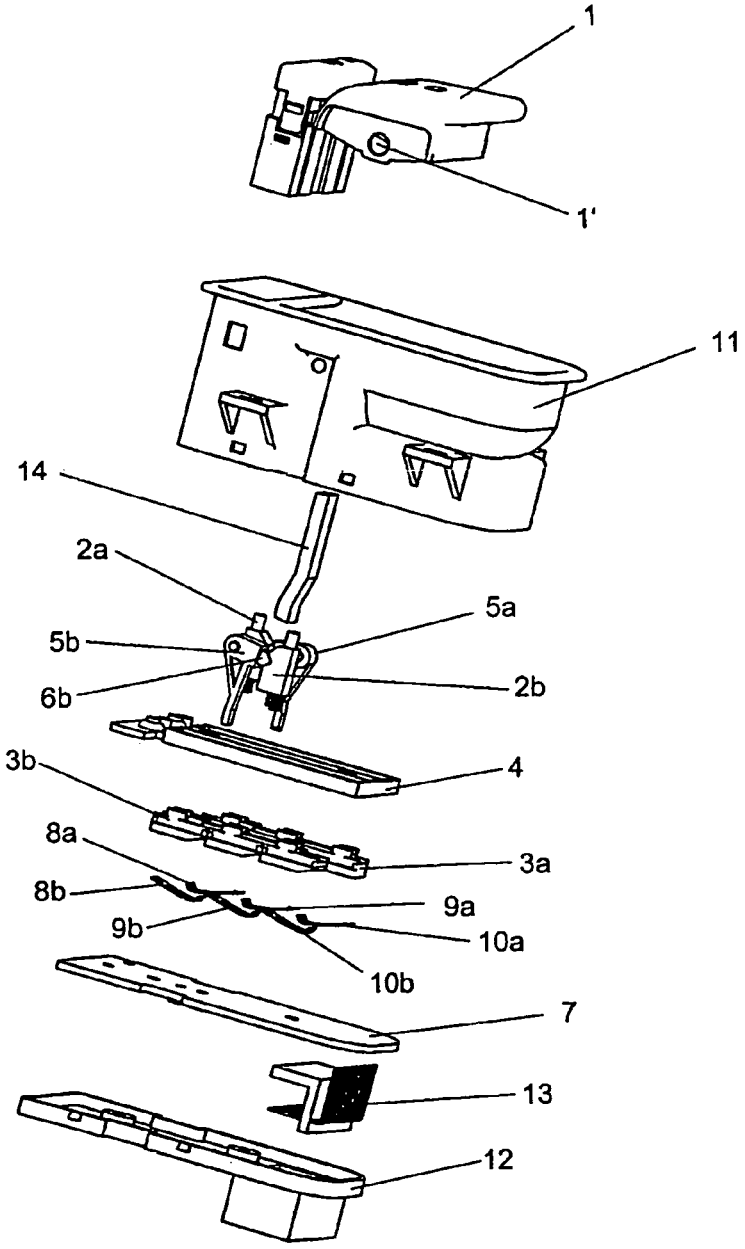
FIG. 1 illustrates an electrical switching device in accordance with an embodiment of the present invention.
Figure 2:
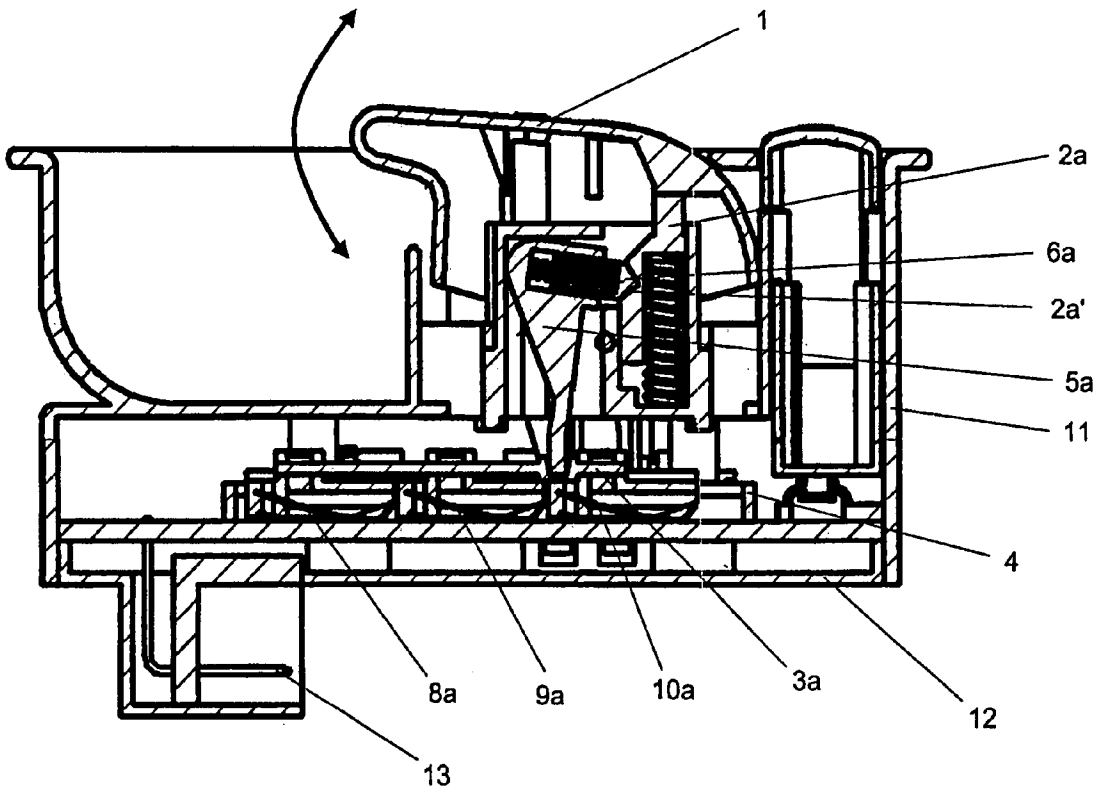
FIG. 2 illustrates a longitudinal section of the electrical switching device shown in FIG. 1.

Referring now to FIGS. 1 and 2, an electrical switching device in accordance with an embodiment of the present invention is shown. The switching device includes an actuating handle 1. Actuating handle 1 is movable in two opposing directions indicated by the double arrow shown in FIG. 2. Actuating handle 1 is movable in a first one of the directions from a neutral starting position into a first end position in response to being pulled. Actuating handle 1 is movable in a second opposite direction from the neutral starting position into a second end position in response to being pressed.

A first restoring mechanism including a first spring-loaded push rod 2*a* is associated with actuating handle 1. A function of push rod 2*a* is to move actuating handle 1 back to its neutral starting position from its first end position after the pulling of actuating handle 1 ceases. Similarly, a second restoring mechanism including a second spring-loaded push rod 2*b* is associated with actuating handle 1. A function of push rod 2*b* is to move actuating handle 1 back to its neutral starting position from its second end position after the pressing of actuating handle 1 ceases.

Push rod 2*a* is located underneath the rear end of actuating handle 1 as shown in FIG. 2. Conversely, push rod 2*b* is located underneath the front end of actuating handle 1. This arrangement is shown in FIG. 1 as push rod 2*a* is on the left side underneath the rear end of actuating handle 1 and push rod 2*b* is on the right side underneath the front end of actuating handle 1.

The shifting device further includes first and second contact carrier elements 3*a*, 3*b*. First contact carrier 3*a* is actuated in response to actuating handle 1 being pulled. Conversely, second contact carrier 3*b* is actuated in response to actuating handle 1 being pressed. Other than the actuation of actuating handle 1 being different (i.e., pulling and pressing) for respectively actuating contact carriers 3*a*, 3*b*, the control for the two actuations of the contact carriers is performed in the same manner.

First contact carrier 3*a* is mounted in a linear guide 4. First contact carrier 3*a* may perform a limited linear motion in linear guide 4 to the right and left between two opposite limiting positions. The limiting positions respectively correspond to left and right neutral end positions of first contact carrier 3*a*. First contact carrier 3*a* includes three sliding contact bridges 8*a*, 9*a*, 10*a* on its underside. Each contact bridge 8*a*, 9*a*, 10*a* is a multi-finger wiper.

In the left end position of first contact carrier 3*a* (shown in FIG. 2), bridges 8*a*, 9*a*, 10*a* respectively span first pairs of stationary contacts. Similarly, in the right end position of first contact carrier 3*a*, bridges 8*a*, 9*a*, 10*a* respectively span second pairs of stationary contacts. Each stationary contact is a contact surface on a printed circuit board (PCB) 7. PCB 7 is also used as a lower slide bearing for first contact carrier 3*a*. The first pairs of PCB contacts are electrically insulated from the second pairs of PCB contacts. The first pairs of PCB contacts respectively contact the contact bridges 8*a*, 9*a*, 10*a* when first contact carrier 3*a* is in the left end position. The second pairs of PCB contacts respectively contact the contact bridges 8*a*, 9*a*, 10*a* when first contact carrier 3*a* is in the right end position. Three separate electrical potentials may thus be simultaneously switched over by displacing first contact carrier 3*a* between its two end positions.

Similarly, second contact carrier 3*b* is mounted in linear guide 4 and may perform a limited linear motion in linear guide 4 to the right and left between two opposite limiting positions respectively corresponding to left and right neutral end positions. Second contact carrier 3*b* includes three sliding contact bridges 8*b*, 9*b*, 10*b* on its underside. Each contact bridge 8*b*, 9*b*, 10*b* is a multi-finger wiper. Bridges 8*b*, 9*b*, 10*b* respectively span an additional set of first pairs of PCB contacts in the left end position of second contact carrier 3*b* and respectively span an additional set of second pairs of PCB contacts in the right end position of second contact carrier 3*b*. Again, each PCB contact is a contact surface on PCB 7 which is also used as a lower slide bearing for second contact carrier 3*b*. The additional set of the first pairs of PCB contacts are electrically insulated from the additional set of the second pairs of PCB contacts. The additional first pairs of PCB contacts respectively contact the contact bridges 8*b*, 9*b*, 10*b* when second contact carrier 3*b* is in the left end position. The additional second pairs of PCB contacts respectively contact the contact bridges 8*b*, 9*b*, 10*b* when second contact carrier 3*b* is in the right end position. Three separate electrical potentials may thus be simultaneously switched over by displacing second contact carrier 3*b* between its two neutral end positions.

Pulling or pressing actuating handle 1 causes actuating handle 1 to perform a corresponding rotation motion about a rotational axis. The rotational axis is formed by a bearing 1' for an axle neck 14 of actuating handle 1. Bearing 1' is in corresponding openings in an upper housing part 11 of a housing. The housing accommodates the components of the switching device and is closed off on its lower side by a lower housing part 12. Actuating handle 1 performs a first rotation motion about its rotational axis in response to the front end of actuating handle 1 being pulled upward along the first direction. In particular, the rear end of actuating handle 1 moves downward from its neutral starting position. Actuating handle 1 performs a second rotation motion about its rotational axis in response to the front end of actuating handle 1 being pressed downward along the second direction. In particular, the front end of actuating handle 1 moves downward from its neutral starting position.

In regards to the pulling of actuating handle 1, the rear end of actuating handle 1 engages and moves push rod 2*a* downward against the opposing elastic force of push rod 2*a*. A locking contour 2*a*' on the longitudinal side of push rod 2*a* slides along a spring-loaded stop bolt 6*a*. Stop bolt 6*a* is in a sleeve of a rocker arm 5*a*. Rocker arm 5*a* is supported in upper housing part 11 so as to be rotatable about a swivel axis oriented parallel to the rotational axis of actuating handle 1. At its lower end facing away from this swivel axis, rocker arm 5*a* is engaged to first contact carrier 3*a*. Rocker arm 5*a* abruptly swivels about its swivel axis with relaxation of the spring of stop bolt 6*a* as soon as the vertex of locking contour 2*a*' of push rod 2*a* passes the tip of stop bolt 6*a* during the downward motion of push rod 2*a*. First contact carrier 3*a*, which is in its left end position and is engaged with the end of rocker arm 5*a*, is abruptly moved to its right end position as a result of this swivel motion of rocker arm 5*a*. First contact carrier 3*a* remains in the right end position as long as the front end of actuating handle 1 is pulled and actuating handle 1 is in its first end position.

When the pulling of actuating handle 1 ceases, the downward force from the rear end of actuating handle 1 acting on push rod 2*a* also ceases. As a result, the elastic force of push rod 2*a* acts upwardly on the rear end of actuating handle 1 to thereby move actuating handle 1 back to its neutral starting position. During this upward motion of push rod 2*a*, the tip of stop bolt 6*a* once again passes the vertex of locking contour 2*a*' such that rocker arm 5*a* performs another abrupt swivel motion about its swivel axis with relaxation of the spring of stop bolt 6*a*. This swivel motion of rocker arm 5*a* is in an opposite direction to the swivel motion when actuating handle 1 is pulled. First contact carrier 3*a* is abruptly returned from its right end position, in the same manner as for the other direction, to its original left end position in response to this swivel motion of rocker arm 5*a*.

In regards to the pressing of actuating handle 1, the front end of actuating handle 1 engages and moves push rod 2*b* downward against the opposing elastic force of push rod 2*b*. A locking contour on the longitudinal side of push rod 2*b* slides along a spring-loaded stop bolt 6*b*. Stop bolt 6*b* is in a sleeve of a rocker arm 5*b*. Rocker arm 5*b* is supported in upper housing part 11 so as to be rotatable about a swivel axis oriented parallel to the rotational axis of actuating handle 1. At its lower end facing away from this swivel axis, rocker arm 5*b* is engaged to second contact carrier 3*b*. Rocker arm 5*b* abruptly swivels about its swivel axis with relaxation of the spring of stop bolt 6*b* as soon as the vertex of the locking contour of push rod 2*b* passes the tip of stop bolt 6*b* during the downward motion of push rod 2*b*. Second contact carrier 3*b*, which is in an end position and is engaged with the end of rocker arm 5*b*, is abruptly moved to its other end position as a result of this swivel motion of rocker arm 5*b*. Second contact carrier 3*b* remains in its other end position as long as the front end of actuating handle 1 is pressed and actuating handle 1 is in its second end position.

When the pressing of actuating handle 1 ceases, the downward force from the front end of actuating handle 1 acting on push 2*b* also ceases. As a result, the elastic force of push rod 2*b* acts upwardly on the front end of actuating handle 1 to thereby move actuating handle 1 back to its neutral starting position. The elastic force against push rod 2*b* causes push rod 2*b* to push actuating handle 1 back to its neutral starting position. During this upward motion of push rod 2*b*, the tip of stop bolt 6*b* once again passes the vertex of the locking contour of push rod 2*b* such that rocker arm 5*b* performs another abrupt swivel motion about its swivel axis with relaxation of the spring of stop bolt 6*b*. This swivel motion of rocker arm 5*b* is in an opposite direction to the swivel motion when actuating handle 1 is pressed. Second contact carrier 3*b* is abruptly returned from its other end position, in the same manner as for the other direction, to its original end position in response to this swivel motion of rocker arm 5*b*.

As such, the displacement of second contact carrier 3*b*, and therefore also of contact bridges 8*b*, 9*b*, 10*b* connected thereto, which occurs when actuating handle 1 is pressed takes place in the same manner via push rod 2*b* and rocker arm 5*b* as the displacement of first contact carrier 3*a* via push rod 2*a* and rocker arm 5*a* when actuating handle 1 is pulled. When one of the pull or press functions is actuated, the transmission elements associated with the respective other actuating direction remain at rest such that contact carrier 3*a* or 3*b* associated with the non-actuated function is securely held in its respective original end position.

In order to connect the switching device to the chassis electrical system, the electrical system includes a plug-in connector whose contact pins 13 on are electrically connected to PCB 7 and enclosed by a collar of lower housing part 12.

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. A switching device comprising:

an actuating handle rotatable about a rotation axis to be movable upward and downward, wherein the actuating handle moves downward in response to being actuated;

a restoring mechanism movable upward and downward, wherein the restoring mechanism is biased with an elastic force to move upward;

wherein the actuating handle engages and forces the restoring mechanism to move downward in response to being actuated;

a contact carrier displaceable between first and second positions; and a rocker arm rotatable about a swivel axis parallel to the rotation axis of the actuating handle, wherein an end of the rocker arm facing away from the swivel axis is engaged with the contact carrier;

wherein the restoring mechanism cooperates with the rocker arm such that during downward movement of the restoring mechanism the restoring mechanism abruptly swivels the rocker arm in a first swivel direction about the swivel axis thereby causing the rocker arm to abruptly displace the contact carrier from the first position to the second position and such that during upward movement of the restoring mechanism the restoring mechanism abruptly swivels the rocker arm in a second opposite swivel direction about the swivel axis thereby causing the rocker arm to abruptly displace the contact carrier back to the second position from the first position.

2. The switching device of claim 1 wherein:

during upward movement of the restoring mechanism the restoring mechanism engages and forces the actuating handle to move upward.

3. The switching device of claim 1 wherein:

the contact carrier includes a contact bridge which contacts a first contact surface of a printed circuit board when the contact carrier is in the first position and contacts a second contact surface of the printed circuit board when the contact carrier is in the second position.

4. The switching device of claim 3 wherein:

the contact bridge includes a multi-finger wiper.

5. The switching device of claim 1 wherein:

the restoring mechanism includes a spring-loaded push rod.

6. The switching device of claim 5 wherein:

the rocker arm includes a spring-loaded stop bolt;

wherein the push rod includes a locking contour which engages with the spring-loaded stop bolt of the rocker arm for the push rod to swivel the rocker arm in the first and second swivel directions.

7. The switching device of claim 1 wherein:

the contact carrier includes three contact bridges which respectively contact first contact surfaces of a printed circuit board when the contact carrier is in the first position and respectively contact second contact surfaces of the printed circuit board when the contact carrier is in the second position to thereby simultaneously switchover three electric potentials.

8. A switching device comprising:

a handle rotatable about a rotation axis, wherein a first end of the handle moves downward from a neutral position in response to the handle being pulled, wherein an opposite second end of the handle moves downward from the neutral position in response to the handle being pressed;

a first rod adjacent to the first end of the handle, the first rod being movable upward and downward relative to the first end of the handle, wherein the first rod is biased with an elastic force to move upward;

a first carrier displaceable between first and second positions;

a second rod adjacent to the second end of the handle, the second rod being movable upward and downward relative to the second end of the handle, wherein the second rod is biased with an elastic force to move upward;

a second carrier displaceable between first and second positions;

a first rocker adjacent to the first rod and rotatable about a first swivel axis parallel to the rotation axis of the handle, wherein an end of the first rocker facing away from the first swivel axis is engaged with the first carrier;

a second rocker adjacent to the second rod and rotatable about a second swivel axis parallel to the rotation axis of the handle, wherein an end of the second rocker facing away from the second swivel axis is engaged with the second carrier;

wherein the first end of the handle engages and forces the first rod to move downward while the first end of the handle moves downward in response to the handle being pulled, wherein the first rod cooperates with the first rocker such that during downward movement of the first rod the first rod abruptly swivels the first rocker in a first swivel direction about the first swivel axis thereby causing the first rocker to abruptly displace the first carrier from the first position to the second position and such that during upward movement of the first rod the first rod abruptly swivels the first rocker in a second opposite swivel direction about the first swivel axis thereby causing the first rocker to abruptly displace the first carrier back to the second position from the first position.

9. The switching device of claim 8 wherein:

during upward movement of the first rod when the pulling of the handle ceases, the first rod engages and forces the first end of the handle to move upward back to the neutral position.

10. The switching device of claim 8 wherein:

the second end of the handle engages and forces the second rod to move downward while the second end of the handle moves downward in response to the handle being pressed, wherein the second rod cooperates with the second rocker such that during downward movement of the second rod the second rod abruptly swivels the second rocker in a first swivel direction about the second swivel axis thereby causing the second rocker to abruptly displace the second carrier from the first position to the second position and such that during upward movement of the second rod the second rod abruptly swivels the second rocker in a second opposite swivel direction about the second swivel axis thereby causing the second rocker to abruptly displace the second carrier back to the second position from the first position.

11. The switching device of claim 10 wherein:

during upward movement of the second rod when the pressing of the handle ceases, the second rod engages and forces the second end of the handle to move upward back to the neutral position.

12. The switching device of claim 9 wherein:

the second end of the handle engages and forces the second rod to move downward while the second end of the handle moves downward in response to the handle being pressed, wherein the second rod cooperates with the second rocker such that during downward movement of the second rod the second rod abruptly swivels the second rocker in a first swivel direction about the second swivel axis thereby causing the second rocker to abruptly displace the second carrier from the first position to the second position and such that during upward movement of the second rod the second rod abruptly swivels the second rocker in a second opposite swivel direction about the second swivel axis thereby causing the second rocker to abruptly displace the second carrier back to the second position from the first position.

13. The switching device of claim 12 wherein:

during upward movement of the second rod when the pressing of the handle ceases, the second rod engages and forces the second end of the handle to move upward back to the neutral position.

14. The switching device of claim 13 wherein:

the second rod remains in place while the first rod is moving upward or downward.

15. The switching device of claim 13 wherein:

the first rod remains in place while the second rod is moving upward or downward.

16. The switching device of claim 8 wherein:

the first rod is a spring-loaded push rod and the second rod is a spring-loaded push rod.

17. The switching device of claim 16 wherein:

the first rocker includes a spring-loaded stop bolt and the second rocker includes a spring-loaded stop bolt;

wherein the first push rod includes a locking contour which engages with the stop bolt of the first rocker for the first push rod to swivel the first rocker in the first and second swivel directions;

wherein the second push rod includes a locking contour which engages with the stop bolt of the second rocker for the second push rod to swivel the second rocker in the first and second swivel directions.

18. The switching device of claim 8 wherein:

the first carrier includes a first contact which contacts a first contact surface of a circuit board when the first carrier is in the first position and contacts a second contact surface of the circuit board when the first carrier is in the second position;

the second carrier includes a second contact which contacts a third contact surface of the circuit board when the second carrier is in the first position and contacts a fourth contact surface of the circuit board when the second carrier is in the second position.

19. The switching device of claim 18 wherein:

each contact includes a multi-finger wiper.

20. The switching device of claim 8 wherein:

the first carrier includes three contacts which respectively contact first contact surfaces of a circuit board when the first carrier is in the first position and respectively contact second contact surfaces of the circuit board when the first carrier is in the second position to thereby enable the simultaneous switchover of three electric potentials;

the second carrier includes three contacts which respectively contact third contact surfaces of the circuit board when the second carrier is in the first position and respectively contact fourth contact surfaces of the circuit board when the second carrier is in the second position to thereby enable the simultaneous switchover of three electric potentials.

* * * * *